US010063986B2

(12) United States Patent
Kobayashi et al.

(10) Patent No.: US 10,063,986 B2
(45) Date of Patent: Aug. 28, 2018

(54) AUDIO PROCESSING DEVICE

(71) Applicant: Onkyo Corporation, Osaka (JP)

(72) Inventors: Junichi Kobayashi, Osaka (JP); Susumu Koaze, Osaka (JP)

(73) Assignee: Onkyo Corporation, Osaka (JP)

( * ) Notice: Subject to any disclaimer, the term of this patent is extended or adjusted under 35 U.S.C. 154(b) by 68 days.

(21) Appl. No.: 15/230,584

(22) Filed: Aug. 8, 2016

(65) Prior Publication Data

US 2017/0064482 A1 Mar. 2, 2017

(30) Foreign Application Priority Data

Aug. 24, 2015 (JP) ..... 2015-164319

(51) Int. Cl.
*H04R 29/00* (2006.01)
*H04S 3/00* (2006.01)
*H04S 1/00* (2006.01)

(52) U.S. Cl.
CPC ..... *H04S 3/008* (2013.01); *H04S 1/007* (2013.01); *H04S 2400/01* (2013.01)

(58) Field of Classification Search
USPC ..... 381/17, 55, 58, 71.13, 85, 150, 307, 386
See application file for complete search history.

(56) References Cited

U.S. PATENT DOCUMENTS 6,268,820 B1 * 7/2001 Sherry ..... G06F 3/05 341/139
2005/0012955 A1 * 1/2005 Edwards ..... H04N 1/32101 358/1.15

FOREIGN PATENT DOCUMENTS

JP 2013-046265 3/2013
JP 2013046265 * 4/2013

* cited by examiner

*Primary Examiner* — Yosef K Laekemariam
(74) *Attorney, Agent, or Firm* — Renner Otto Boisselle & Sklar, LLP

(57) ABSTRACT

In an audio processing device having a first output route and a second output route, to be able to reproduce the same audio signal as the first output rote at the second output route. A microcomputer 2 connects a Zone2 reproduction device 6 with a DAC 10 for a surround back by a switch 17 and the DAC 10 for the surround back with a surround back analog output terminal 15 by a switch 18 in case that the DSD data is reproduced at a Zone2 output route.

8 Claims, 5 Drawing Sheets

AUDIO PROCESSING DEVICE

BACKGROUND OF THE INVENTION

1. Field of the Invention

The present invention relates to an audio processing device that performs audio signal processing to a digital audio signal.

2. Description of the Related Art

As an audio processing device that performs audio signal processing such as D/A conversion and amplification to a digital audio signal, there is an AV receiver. The AV receiver that is described in JP 2013-046265 A performs audio signal processing to the digital audio signal and outputs an analog audio signal to main speakers that are located in a main room (main output route (first output route)). The AV receiver that is described in JP 2013-046265A performs audio signal processing to the digital audio signal and outputs the analog audio signal to Zone2 speakers (sub speakers) that are located in a Zone2 room (sub room) (Zone2 output route (second output route)).

FIG. 5 is a block diagram illustrating a configuration of a conventional AV receiver. For example, an AV receiver 101 can perform audio signal processing to a 7.1 channels digital audio signal. As illustrated in FIG. 5, the AV receiver 101 includes a DSP 105, a Zone2 reproduction device 106, and DACs 107 to 111. The DSP 105 is a device that reproduces the digital audio signal. The DSP 105 is a device for reproducing an audio signal that is output to the main speakers. The Zone2 reproduction device 106 is a device that reproduces the digital audio signal. The Zone2 reproduction device 106 is a device for reproducing an audio signal that is output to the Zone2 speakers. Each of the DACs 107 to 110 D/A-converts the digital audio signal that is output from the DSP 105 into the analog audio signal. Each of the DACs 107 to 110 can D/A-convert DSD (Direct Stream Digital) data and PCM (Pulse Code Module) data. Further, each of the DACs 107 to 110 is a 2 channels DAC.

A front left digital audio signal and a front right digital audio signal are input to the DAC 107. The DAC 107 D/A-converts the front left digital audio signal and the front right digital audio signal into a front left analog audio signal and a front right analog audio signal and outputs the front left analog audio signal and the front right analog audio signal to a front left analog output terminal and a front right analog output terminal. A center digital audio signal and a subwoofer digital audio signal are input to the DAC 108. The DAC 108 D/A-converts the center digital audio signal and the subwoofer digital audio signal into a center analog audio signal and a subwoofer analog audio signal and outputs the center analog audio signal and the subwoofer analog audio signal to a center analog output terminal and a subwoofer analog output terminal. A surround left digital audio signal and a surround right digital audio signal are input to the DAC 109. The DAC 109 D/A-converts the surround left digital audio signal and the surround right digital audio signal into a surround left analog audio signal and a surround right analog audio signal and outputs the surround left analog audio signal and the surround right analog audio signal to a surround left analog output terminal and a surround right analog output terminal. A Surround back left digital audio signal and a surround back right digital audio signal are input to the DAC 110. The DAC 110 D/A-converts the surround back left digital audio signal and the surround back right digital audio signal into a surround back left analog audio signal and a surround back right analog audio signal and outputs the surround back left analog audio signal and the surround back right analog audio signal to a surround back left analog output terminal and a surround back right analog output terminal.

The DAC 111 D/A-converts the digital audio signal that is output from the Zone2 reproduction device 106 into the analog audio signal. The DAC 111 can D/A-convert the PCM data but cannot D/A-convert the DSD data. Further, the DAC 111 is a 2 channels DAC. A Zone2 left digital audio signal and a Zone2 right digital audio signal are input to the DAC 111. The DAC 111 D/A-converts the Zone2 left digital audio signal and the Zone2 right digital audio signal into a Zone2 left analog audio signal and a Zone2 right analog audio signal and outputs the Zone2 left analog audio signal and the Zone2 right analog audio signal to a Zone2 left analog output terminal and a Zone2 right analog output terminal.

A front left speaker and a front right speaker are respectively connected to the front left analog output terminal and the front right analog output terminal. A center speaker and a subwoofer speaker are respectively connected to the center analog output terminal and the subwoofer output terminal. A surround left speaker and a surround right speaker are respectively connected to the surround left analog output terminal and the surround right analog output terminal. A surround back left speaker and a surround back right speaker are respectively connected to the surround back left analog output terminal and the surround back right analog output terminal. The main speakers are configured by the front left speaker, the front right speaker, the center speaker, the subwoofer speaker, the surround left speaker, the surround right speaker, the surroundback left speaker, and the surround back right speaker. The main speakers reproduce an audio according to a 7.1 channels analog audio signal that is output from the DACs 107 to 110.

A front left speaker and a front right speaker are respectively connected to the Zone2 left analog output terminal and the Zones2 right analog output terminal. The Zone2 speakers are configured by the frond left speaker and the front right speaker. The Zone2 speakers reproduce an audio according to a 2 channels analog audio signal that is output from the DAC 111.

In the above mentioned conventional AV receiver 101, a cheap device that cannot D/A-convert the DSD data in which data quantity is large is used as the DAC 111 for Zone2 to reduce product unit price. For this reason, there is a problem that the DSD data cannot be reproduced and output to the Zone2 room.

SUMMARY OF THE INVENTION

An objective of the present invention is to be able to reproduce the same audio signal as a first output route at a second output route in an audio processing device that has the first output route and the second output route.

An audio processing device having a first output route and a second output route comprising: a first reproduction device that is included in the first output route; a second reproduction device that is included in the second output route; a first D/A converter that D/A-converts a first digital audio signal and a second digital audio signal in which data format is different from the first digital audio signal; a second D/A converter that D/A converts the second digital audio signal; a first analog output terminal that is included in the first output route; a second analog output terminal that is included in the second output route; a first switch that connects the first reproduction device with the first D/A converter or the second D/A converter and connects the second reproduction device with the first D/A converter or the second D/A converter; a second switch that connects the first D/A converter with the first analog output terminal or the second analog output terminal and connects the second D/A converter with the first analog output terminal or the second analog output terminal; and a controller that connects the second reproduction device with the first D/A converter by the first switch and connects the first D/A converter with the second analog output terminal by the second switch in case that the first digital audio signal is reproduced at the second output route.

In the present invention, in case that a first digital audio signal is reproduced at a second output route, a controller connects a second reproduction device with a first D/A converter by a first switch and connects the first D/A converter with a second analog output terminal by a second switch. Therefore, the first digital audio signal that is output from the second reproduction device is D/A-converted by the first D/A converter. Then, an analog audio signal that is D/A-converted is output to the second analog output terminal. Thus, according to the present invention, the same audio signal as a first output route can be reproduced at a second output route.

Preferably, wherein the controller connects the second reproduction device with the first D/A converter by the first switch and connects the first D/A converter with the second analog output terminal by the second switch in case that the first digital audio signal is reproduced at the second output route if a digital audio signal is not input to the first D/A converter.

In case that the second reproduction device and the first D/A converter are connected by the first switch, the first D/A converter and the second analog output terminal are connected by the second switch, a first reproduction device and a second D/A converter are connected by the first switch, and the second D/A converter and a first analog output terminal are connected by the second switch while reproducing a digital audio signal at the first output route to reproduce the first digital audio signal at the second output route, interruption of sound occurs in an audio signal of the first output route. For this reason, in the present invention, in case that the first digital audio signal is reproduced at the second output route, if the digital audio signal is not input to the first D/Aconverter, the controller connects the second reproduction device with the first D/A converter by the first switch. Further, the controller connects the first D/A converter with the second analog output terminal by the second switch. Thus, occurring of sound interruption is prevented at the first output route.

Preferably, wherein the controller connects the first reproduction device with the second D/A converter by the first switch, connects the second reproduction device with the first D/A converter by the first switch, connects the second D/A converter with the first analog output terminal by the second switch, and connects the first D/A converter with the second analog output terminal by the second switch in case that the second digital audio signal is reproduced at the first output route and the first digital audio signal is reproduced at the second output route.

In the present invention, the controller connects the first reproduction device with the second D/A converter by the first switch and connects the second D/A converter with the first analog output terminal by the second switch in case that the second digital audio signal is reproduced at the first output route. Therefore, the second digital audio signal that is output from the first reproduction device is D/A converted by the second D/A converter. Then, the analog audio signal that is D/A-converted is output to the first analog output terminal.

An audio processing device having a first output route and a second output route comprising: a first reproduction device that is included in the first output route; a second reproduction device that is included in the second output route; a first D/A converter that D/A-converts a digital audio signal; a second D/A converter that D/A-converts the digital audio signal and in which performance is inferior in the first D/A converter; a first analog output terminal that is included in the first output route; a second analog output terminal that is included in the second output route; a first switch that connects the first reproduction device with the first D/A converter or the second D/A converter and connects the second reproduction device with the first D/A converter or the second D/A converter; a second switch that connects the first D/A converter with the first analog output terminal or the second analog output terminal and connects the second D/A converter with the first analog output terminal or the second analog output terminal; and a controller that connects the second reproduction device with the first D/A converter by the first switch and connects the first D/A converter with the second analog output terminal by the second switch in case that the digital audio signal is reproduced at the second output route.

In the present invention, in case that a first digital audio signal is reproduced at a second output route, a controller connects a second reproduction device with a first D/A converter by a first switch and connects the first D/A converter with a second analog output terminal by a second switch. Therefore, the first digital audio signal that is output from the second reproduction device is D/A-converted by the first D/A converter. Then, an analog audio signal that is D/A-converted is output to the second analog output terminal. Thus, according to the present invention, the same quality audio signal as a first output route can be reproduced at a second output route.

Preferably, wherein the first output route reproduces a 7.1 channels digital audio signal, the second output route reproduces a 2 channels digital audio signal, the first D/A converter includes four D/A converters that respectively D/A-convert a 2 channels digital audio signal, the second D/A converter is a D/A converter that D/A-converts a 2 channels digital audio signal, the first switch connects a surround back port that outputs a surround back left digital audio signal and a surround back right digital audio signal of the first reproduction device with a surround back D/A converter for the surround back left digital audio signal and the surround back right digital audio signal of the first D/A converter or the second D/A converter and connects the second reproduction device with the surround back D/A converter or the second D/A converter, and the second switch connects the surround back D/A converter with a surround back analog output terminal for the surround back left analog audio signal and the surround back right audio signal of the first analog output terminal or the second analog output terminal and connects the second D/A converter with the surround back analog output terminal or the second analog output terminal.

In case of the digital audio signal less than 5.1 channels, a surround back D/A converter is not used because a surround back digital audio signal is not included in the digital audio signal. In the present invention, the first switch connects a surround back port of the first reproduction device with the surround back D/A converter or the second D/A converter and connects the second reproduction device with the surround back D/A converter or the second D/A converter. Further, the second switch connects the surround back D/A converter with a surround back analog output terminal or the second analog output terminal and connects the second D/A converter with the surround back analog output terminal or the second analog output terminal. Therefore, an audio signal can be reproduced at the second output route using the surround back D/A converter in which frequency of use is lower than the other D/A converters.

Preferably, wherein the first output route reproduces a 5.1 channels digital audio signal, the second output route reproduces a 2 channels digital audio signal, the first D/A converter includes three D/A converters that respectively D/A-convert a 2 channels digital audio signal, the second D/A converter is a D/A converter that D/A-converts a 2 channels digital audio signal, the first switch connects a surroundport that outputs a surround left digital audio signal and a surround right digital audio signal of the first reproduction device with a surround D/A converter for a surround left digital audio signal and a surround right digital audio signal among the first D/A converter or the second D/A converter and connects the second reproduction device with the surround D/A converter or the second D/A converter, and the second switch connects the surround D/A converter with a surround analog output terminal for the surround left analog audio signal and the surround right analog audio signal of the first analog output terminal or the second analog output terminal and connects the second D/A converter with the surround analog terminal or the second analog output terminal.

For example, in case of a 2.1 channels digital audio signal, a surround D/A converter is not used because a surround digital audio signal is not included in the digital audio signal. In the present invention, the first switch connects a surround port of the first reproduction device with the surround D/A converter or the second D/A converter and connects the second reproduction device with the surround D/A converter or the second D/A converter. Further, the second switch connects the surround D/A converter with the surround analog output terminal or the second analog output terminal and connects the second D/A converter with the surround analog output terminal or the second analog output terminal. Therefore, the audio signal can be reproduced at the second output route using the surround D/A converter in which frequency of use is lower than the other D/A converter.

Preferably, wherein data amount of the first digital audio signal is larger than data amount of the second digital audio signal.

Preferably, wherein the first digital signal is DSD data, and the second digital audio signal is PCM data.

In the present invention, in case that DSD data is reproduced at the second output route, the controller connects the second reproduction device with the first D/A converter by the first switch and connects the first D/A converter with the second analog output terminal by the second switch. Therefore, the DSD data that is output fromthe second reproduction device is D/A-converted by the first D/A converter. Then, the analog audio signal that is D/A-converted is output to the second analog output terminal. Thus, according to the present invention, the DSD data can be reproduced at the second output route.

According to the present invention, in an audio processing device having a first output route and a second output route, the same audio signal is reproduced as the first output route at the second output route.

DETAILED DESCRIPTION OF THE PREFERRED EMBODIMENTS

An embodiment of the present invention is described below.

(First Embodiment)

Figure 1:
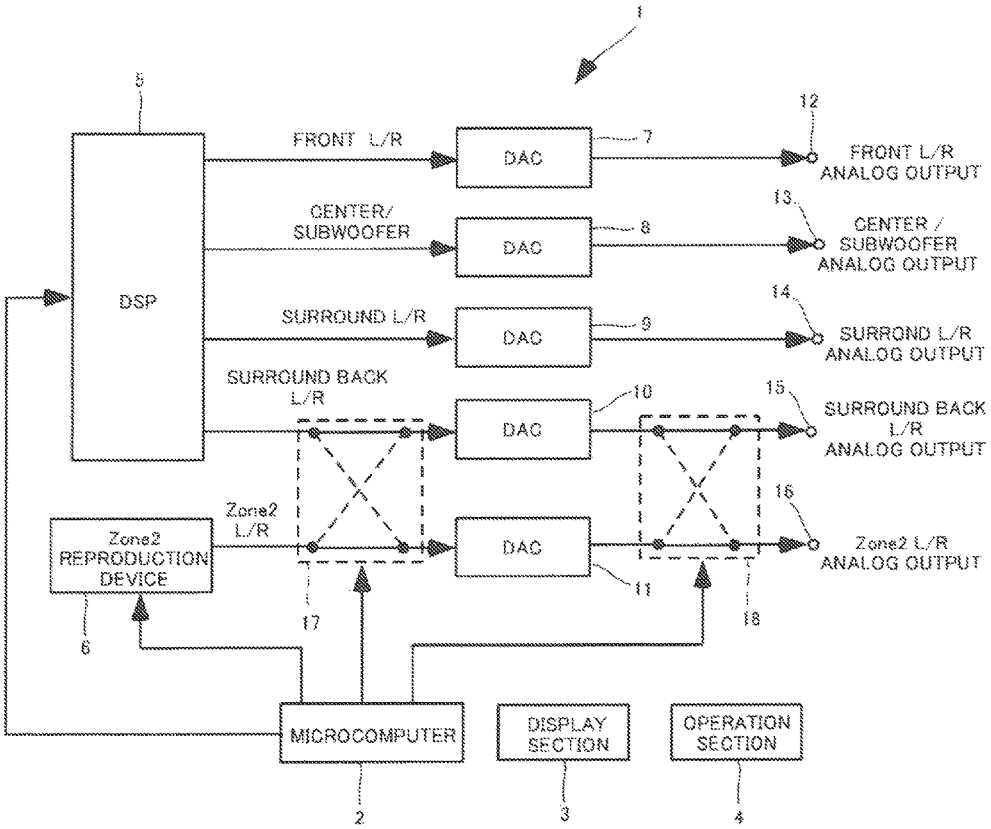
FIG. 1 is a block diagram illustrating a configuration of an AV receiver according to a first embodiment of the present invention.
Figure 2:
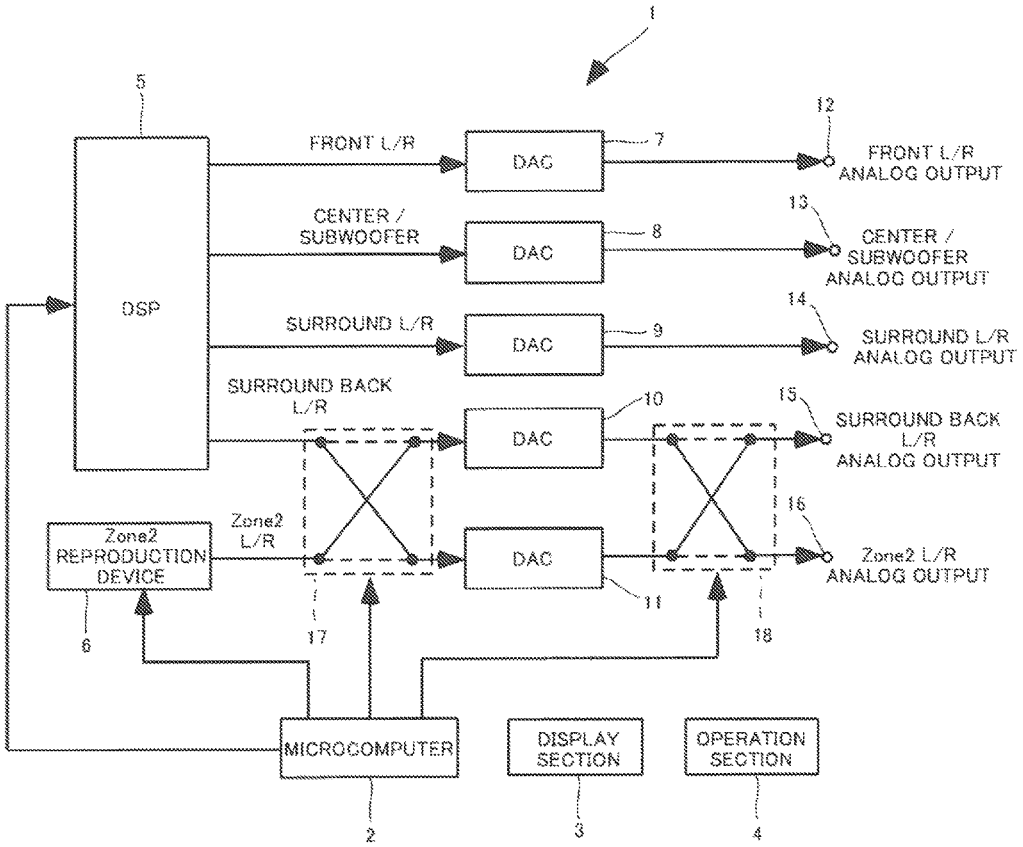
FIG. 2 is a block diagram illustrating a configuration of the AV receiver according to the first embodiment of the present invention.

Each of FIG. 1 and FIG. 2 is a block diagram illustrating a configuration of an AV receiver according to a first embodiment of the present invention. An AV receiver 1 has a main output route and a Zone2 output route. The AV receiver 1 performs audio signal processing to a digital audio signal and outputs an analog audio signal to main speakers that are located in a main room (main output route (first output route)). Further, the AV receiver 1 performs audio signal processing to the digital audio signal and outputs the analog audio signal to Zone2 speakers (sub speakers) that are located in a Zone2 room (sub room) (Zone2 output route (second output route)).

The AV receiver 1 can perform audio signal processing to a 7.1 channels digital audio signal. As illustrated in FIG. 1 and FIG. 2, the AV receiver 1 includes a microcomputer 2, a display section 3, an operation section 4, a DSP 5, a Zone2 reproduction device 6, DACs 7 to 11, analog output terminals 12 to 16, and switches 17 and 18.

The microcomputer 2 (controller) controls respective sections composing the AV receiver 1. The display section 3 displays a setting screen, a volume level and so on. The display section 3 is configured by a LCD (Liquid Crystal Display), a fluorescence display tube, and so on. The operation section 4 is for receiving user operation. The operation section 4 is configured by operation buttons that are provided at an enclosure of the AV receiver 1 and a remote controller. A user can direct it to the AV receiver 1 by operating the operation section 4 that an input audio signal is output to the main speakers or the Zone2 speakers.

The DSP 5 (first reproduction device) is a device that reproduces the digital audio signal. The DSP 5 is a reproduction device for an audio signal that is output to the main speakers. The Zone2 reproduction device 6 (second reproduction device) reproduces the digital audio signal. The Zone2 reproduction device 6 is a reproduction device for the audio signal that is output to the Zone2 speakers. Each of the DACs 7 to 10 (first D/A converter) D/A-converts the digital audio signal into the analog audio signal. Each of the DACs 7 to 10 can D/A-convert DSD (Direct Stream Digital) data (first digital audio signal) and PCM (Pulse Code Module) data (second digital audio signal). Further, each of the DACs 7 to 10 is a 2 channels DAC.

A front left digital audio signal and a front right digital audio signal are input from the DSP 5 to the DAC7. The DAC7 D/A-converts the front left digital audio signal and the front right digital audio signal into a front left analog audio signal and a front right analog audio signal and outputs the front left analog audio signal and the front right analog audio signal to a front analog output terminal (a front left analog output terminal and a front right analog output terminal). A center digital audio signal and a subwoofer digital audio signal are input from the DSP 5 to the DAC 8. The DAC 8 D/A-converts the center digital audio signal and the subwoofer digital audio signal into a center analog audio signal and a subwoofer analog audio signal and outputs the center analog audio signal and the subwoofer analog audio signal to a center/subwoofer analog output terminal 13 (a center analog output terminal and a subwoofer analog output terminal). A surround left digital audio signal and a surround right digital audio signal are input from the DSP 5 to the DAC 9. The DAC 9 D/A-convers the surround left digital audio signal and the surround right digital audio signal into a surround left analog audio signal and a surround right analog audio signal and outputs the surround left analog audio signal and the surround right analog audio signal to a surround analog output terminal 14 (a surround left analog output terminal and a surround right analog output terminal).

In case that is illustrated in FIG. 1, a surround back left digital audio signal and a surround back right digital audio signal are input from the DSP 5 to the DAC 10 (surround back D/A converter). The DAC 10 D/A-converts the surround back left digital audio signal and the surround back right digital audio signal into a surround back left analog audio signal and a surround back right analog audio signal and outputs the surround back left analog audio signal and the surround back right analog audio signal to a surround back analog output terminal 15 (a surround back left analog output terminal and a surround back right analog output terminal). Further, in case that is illustrated in FIG. 2, a Zone2 left digital audio signal and a Zone2 right digital audio signal are input from the Zone2 reproduction device 6 to the DAC 10. The DAC 10 D/A-converts the Zone2 left digital audio signal and the Zone2 right digital audio signal into a Zone 2 left analog audio signal and a Zone2 right analog audio signal and outputs the Zone2 left analog audio signal and the Zone2 right analog audio signal to a Zone2 analog output terminal 16 (a Zone2 left analog output terminal and a Zone2 right analog output terminal).

The DAC 11 (second D/A converter) D/A-converts the digital audio signal into the analog audio signal. The DAC 11 can D/A-convert the PCM data but cannot D/A-convert the DSD data. Further, the DAC 11 is a 2 channels DAC. In case that is illustrated in FIG. 1, the Zone2 left digital audio signal and the Zone2 right digital audio signal are input from the Zone2 reproduction device 6 to the DAC 11. The DAC 11 D/A-converts the Zone2 left digital audio signal and the Zone2 right digital audio signal into the Zone2 left analog audio signal and the Zone2 right analog audio signal and outputs the Zone2 left analog audio signal and the Zone2 right analog audio signal to a Zone2 analog output terminal 16 (a Zone2 left analog output terminal and a Zone2 right analog output terminal). In case that is illustrated in FIG. 2, the surround back left digital audio signal and the surround back right digital audio signal are input from the DSP 5 to the DAC 11. The DAC 11 D/A-converts the surround back left digital audio signal and the surround back right digital audio signal into the surround back left analog audio signal and the surround back right analog audio signal and outputs the surround back left analog audio signal and the surround back right analog audio signal to the surround back analog output terminal 15 (the surround back left analog output terminal and the surround back right analog output terminal).

A front left speaker and a front right speaker are connected to the front analog output terminal 12 (the front left analog output terminal and the front right analog output terminal). A center speaker and a subwoofer speaker are connected to the center/subwoofer analog output terminal 13 (the center analog output terminal and the subwoofer analog output terminal). A surround left speaker and a surround right speaker are connected to the surround analog output terminal 14 (the surround left analog output terminal and the surround right analog output terminal). A surround back left speaker and a surround back right speaker are connected to the surround back analog output terminal 15 (the surround back left analog output terminal and the surround back right analog output terminal). The main speakers are configured by the front left speaker, the front right speaker, the center speaker, the subwoofer speaker, the surround left speaker, the surround right speaker, the surround back left speaker, and the surround back right speaker. The main speakers reproduce an audio according to a 7.1 channels analog audio signal.

A front left speaker and a front right speaker are connected to the Zone2 analog output terminal 16 (the Zone2 left analog output terminal and the Zone2 right analog output terminal). The Zone2 speakers are configured by the front left speaker and the front right speaker. The Zone2 speakers reproduce the audio according to a 2 channels analog audio signal.

The switch 17 (first switch) connects a surround back port of the DSP 5 with the DAC 10 or the DAC 11. Further, the switch 17 connects the Zone2 reproduction device 6 with the DAC 10 or the DAC 11. For example, a PLD is used as the switch 17. The surround back port is a port to which the surround back left digital audio signal and the surround back right digital audio signal are output.

The switch 18 (second switch) connects the DAC 10 with the surround back analog output terminal 15 or the Zone2 analog output terminal 16. Further, the switch 18 connects the DAC 11 with the surround back analog output terminal 15 or the Zone2 analog output terminal 16. For example, the switch 18 is a speaker relay.

In case that the DSD data is reproduced at the Zone2 output route, namely, the audio is output from the Zone2 speakers based on the DSD data, the microcomputer 2 connects the Zone2 reproduction device 6 with the DAC 10 by the switch 17 as illustrated in FIG. 2. Further, the microcomputer 2 connects the DAC 10 with the Zone2 analog output terminal 16 by the switch 18. For this reason, the DSD data that is output from the Zone2 reproduction device 6 is D/A-converted by the DAC 10. Then, the analog audio signal that is D/A-converted is output to the Zone2 analog output terminal 16.

As illustrated in FIG. 2, the microcomputer 2 connects the surround back port of the DSP 5 with the DAC 11 by the switch 17. Further, the microcomputer 2 connects the DAC 11 with the surround back analog output terminal 15 by the switch 18.

In case that the Zone2 reproduction device 6 and the DAC 10 are connected by the switch 17, the DAC 10 and the Zone2 analog output terminal 16 are connected by the switch 18, the DSP 5 and the DAC 11 are connected by the switch 17, and the DAC 11 and the surround back analog output terminal 15 are connected by the switch 18 while reproducing the 7.1 channels digital audio signal at the main output route to reproduce the DSD data at the Zone2 output route, interruption of sound occurs in the surround back audio signal of the main output route. For this reason, in case that the DSD data is reproduced at the Zone2 output route, if the surround back digital audio signal is not input to the DAC 10, the microcomputer 2 connects the Zone2 reproduction device 6 with the DAC 10 by the switch 17 as illustrated in FIG. 2. Further, the microcomputer 2 connects the DAC 10 with the Zone2 analog output terminal 16 by the switch 18. Thus, occurring of sound interruption is prevented at the main output route.

In case that the PCM data is reproduced at the Zone2 output route, namely, the audio is output from the Zone2 speaker based on the PCMdata, themicrocomputer 2 connects the Zone2 reproduction device 6 with the DAC 11 by the switch 17 as illustrated in FIG. 1. Further, the microcomputer 2 connects the DAC 11 with the Zone2 analog output terminal 16 by the switch 18. For this reason, the PCM data that is output from the Zone2 reproduction device 6 is D/A-converted by the DAC 11. Then, the analog audio signal that is D/A-converted is output to the Zone2 analog output terminal 16.

As illustrated in FIG. 1, the microcomputer 2 connects the surround back port of the DSP 5 with the DAC 10 by the switch 17. Further, the microcomputer 2 connects the DAC 10 with the surround back analog output terminal 15 by the switch 18.

As described in the above, in the present embodiment, in case that the DSD data is reproduced at the Zone2 output route, the microcomputer 2 connects the Zone2 reproduction device 6 with the DAC 10 by the switch 17 and connects the DAC 10 with the Zone2 analog output terminal 18 by the switch 18 as illustrated in FIG. 2. Therefore, the DSD data that is output from the Zone2 reproduction device 6 is D/A-converted by the DAC 10. Then, the analog audio signal that is D/A-converted is output to the Zone2 analog output terminal 16. Thus, according to the present embodiment, the same audio signal as the main output route can be reproduced at the Zone2 output route.

In case of the digital audio signal less than 5.1 channels, the DAC 10 for a surround back is not used because the surround back digital audio signal is not included in the digital audio signal. In the present embodiment, the switch 17 connects the surround back port of the DSP 5 with the DAC 10 or the DAC 11 and connects the Zone2 reproduction device 6 with the DAC 10 or the DAC 11. Further, the switch 18 connects the DAC 10 with the surround back analog output terminal 15 or the Zone2 analog output terminal 16 and connects the DAC 11 with the surround back analog output terminal 15 or the Zone2 analog output terminal 16. Therefore, the audio signal can be reproduced at the Zone2 output route using the DAC 10 for the surround back in which frequency of use is lower than the other DACs 7 to 9.

(Second Embodiment)

Figure 3:
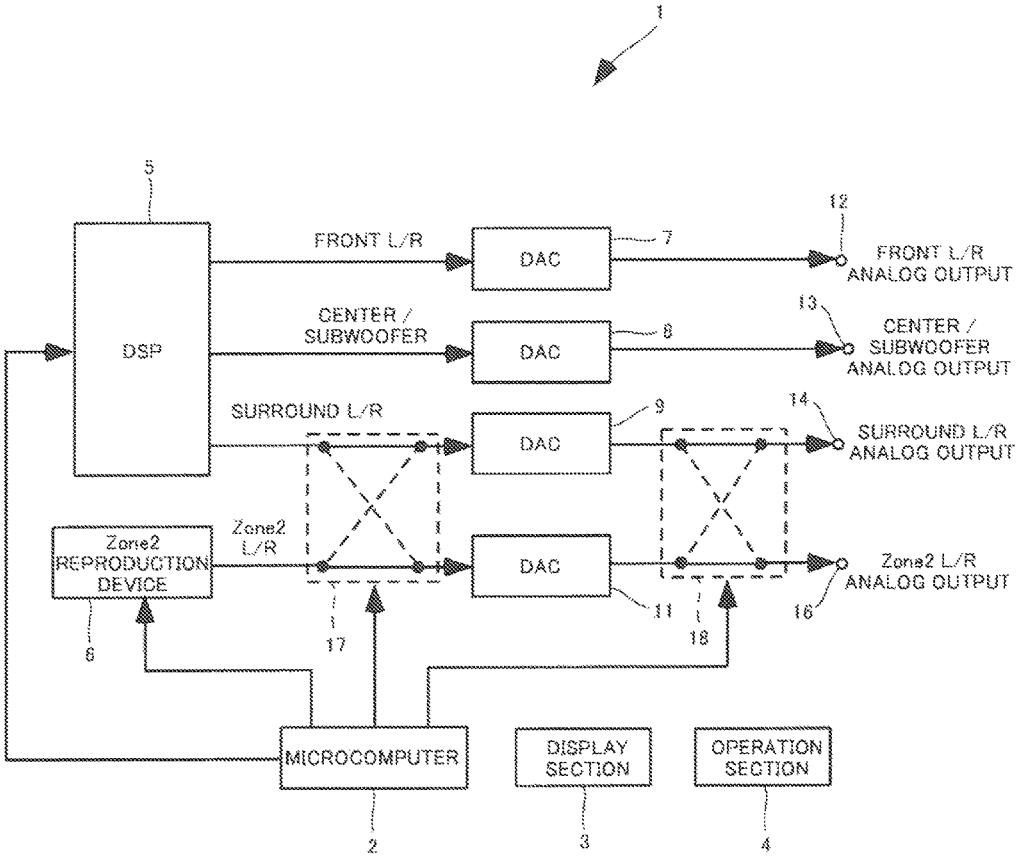
FIG. 3 is a block diagram illustrating a configuration of an AV receiver according to a second embodiment of the present invention.
Figure 4:
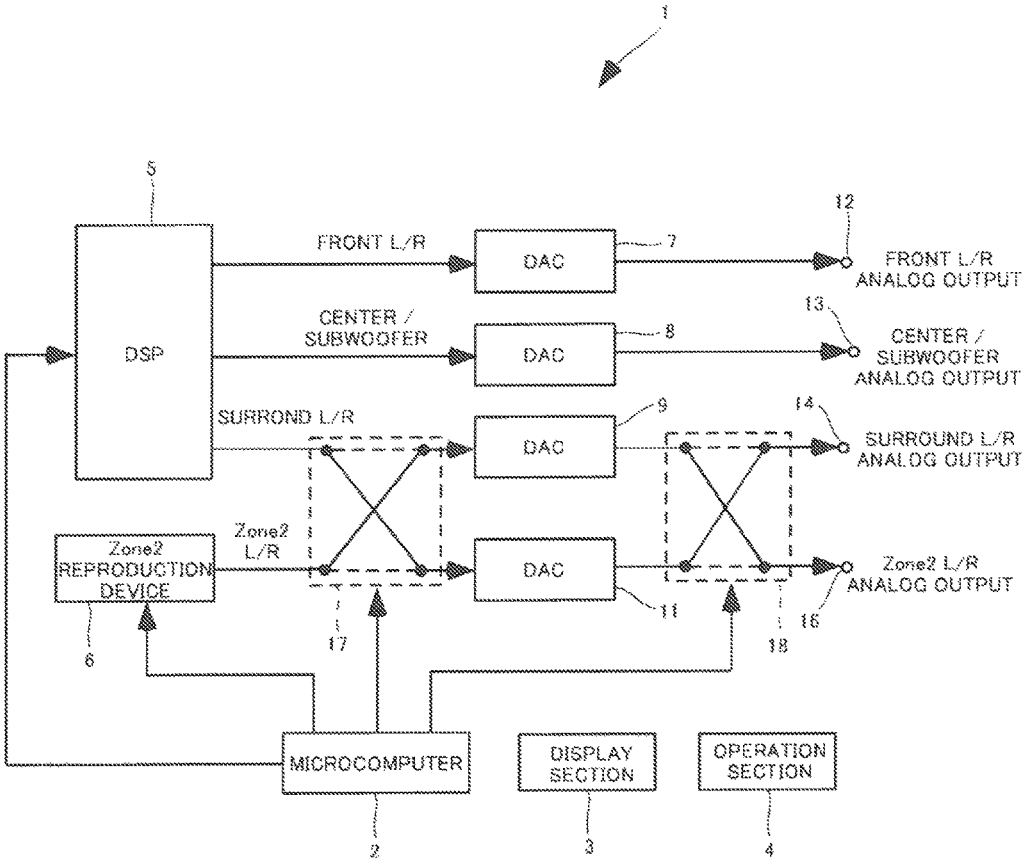
FIG. 4 is a block diagram illustrating a configuration of the AV receiver according to the second embodiment of the present invention.
Figure 5:
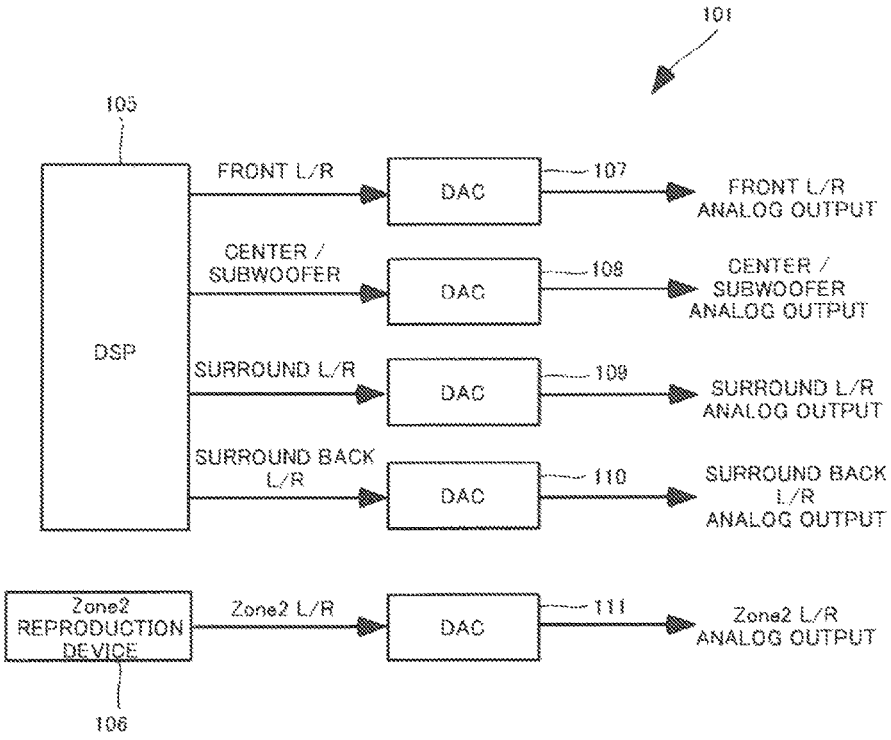
FIG. 5 is a block diagram illustrating a configuration of a conventional AV receiver.

Each of FIG. 3 and FIG. 4 is a block diagram of a configuration of an AV receiver according to a second embodiment of the present invention. Configuration that the AV receiver 1 according to the second embodiment does not include the DAC 10 for surround back is mainly different compared with the AV receiver 1 according to the first embodiment. Therefore, the AV receiver 1 includes three DACs 7 to 9 and can perform audio signal processing to a 5.1 channels digital audio signal. The configuration different from the first embodiment is hereinafter described.

The switch 17 connects a surround port of the DSP 5 with the DAC 9 or the DAC 11. Further, the switch 17 connects the Zone2 reproduction device 6 with the DAC 9 or the DAC 11. The switch 18 connects the DAC 9 with the surround analog output terminal 14 or the Zone2 analog output terminal 16. The surround port is a port that outputs the surround left digital audio signal and the surround right digital audio signal.

In case that the DSD data is reproduced at the Zone2 output route, namely, the audio is output from the Zone2 speakers based on the DSD data, the microcomputer 2 connects the Zone2 reproduction device 6 with the DAC 9 by the switch 17 as illustrated in FIG. 4. Further, the microcomputer 2 connects the DAC 9 with the Zone2 analog output terminal 16 by the switch 18. For this reason, the DSD data that is output from the Zone2 reproduction device 6 is D/A-converted by the DAC 9. Then, the analog audio signal that is D/A-converted is output to the Zone2 analog output terminal 16.

As illustrated in FIG. 4, the microcomputer 2 connects the surround port of the DSP 5 with the DAC 11 by the switch 17. Further, the microcomputer 2 connects the DAC 11 with the surround analog output terminal 14 by the switch 18.

In case that the Zone2 reproduction device 6 and the DAC 9 are connected by the switch 17, the DAC 9 and the Zone2 analog output terminal 16 are connected by the switch 18, the DSP 5 and the DAC 11 are connected by the switch 17, and the DAC 11 and the surround analog output terminal 14 are connected by the switch 18 while reproducing a 5.1 channels digital audio signal at the main output route to reproduce the DSD data at the Zone2 output route, interruption of sound occurs in the surround audio signal of the main output route. For this reason, in case that the DSD data is reproduced at the Zone2 output route, if the surround digital audio signal is not input to the DAC 9, the microcomputer 2 connects the Zone2 reproduction device 6 with the DAC 9 by the switch 17 as illustrated in FIG. 4. Further, the microcomputer 2 connects the DAC 9 with the Zone2 analog output terminal 16 by the switch 18. Thus, occurring of sound interruption is prevented at the main output route.

In case that the PCM data is reproduced at the Zone2 output route, namely, the audio is output from the Zone2 speakers based on the PCMdata, themicrocomputer 2 connects the Zone2 reproduction device 6 with the DAC 11 by the switch 17 as illustrated in FIG. 3. Further, the microcomputer 2 connects the DAC 11 with the Zone2 analog output terminal 16 by the switch 18. For this reason, the PCM data that is output from the Zone2 reproduction device 6 is D/A-converted by the DAC 11. Then, the analog audio signal that is D/A-converted is output to the Zone2 analog output terminal 16.

As illustrated in FIG. 3, the microcomputer 2 connects the surround port of the DSP 5 with the DAC 9 by the switch 17. Further, the microcomputer 2 connects the DAC 9 with the surround analog output terminal 14 by the switch 18.

As described in the above, in the present embodiment, in case that the DSD data is reproduced at the Zone2 output route, the microcomputer 2 connects the Zone2 reproduction device 6 with the DAC 9 by the switch 17 and connects the DAC 9 with the Zone2 analog output terminal 16 by the switch 18 as illustrated in FIG. 4. Therefore, the DSD data that is output from the Zone2 reproduction device 6 is D/A-converted by the DAC 9. Then, the analog audio signal that is D/A-converted is output to the Zone2 analog output terminal 16. Thus, according to the present embodiment, the same audio signal as the main output route can be reproduced in the Zone2 output route.

For example, in case of a 2.1 channels digital audio signal, the DAC 9 for a surround is not used because the surround digital audio signal is not included in the digital audio signal.

In the present embodiment, the switch 17 connects the surround port of the DSP 5 with the DAC 9 or the DAC 11 and connects the Zone2 reproduction device 6 with the DAC 9 or the DAC 11. Further, the switch 18 connects the DAC 9 with the surround analog output terminal 14 or the Zone2 analog output terminal 16 and connects the DAC 11 with the surround analog output terminal 14 or the Zone2 analog output terminal 16. Therefore, the audio signal can be reproduced at the Zone2 output route using the DAC 9 for the surround in which frequency of use is lower than the other DACs 7 and 8.

The embodiment of the present invention is described above, but the mode to which the present invention is applicable is not limited to the above embodiment and can be suitably varied without departing from the scope of the present invention.

In the above mentioned embodiment, each of the DACs 7 to 10 can D/A-convert the PCM data and the DSD data. The DAC 11 can D/A-convert the PCM data but cannot D/A-convert the DSD data. Thus, data format that can be D/A-converted is different between the DACs 7 to 10 and the DAC 11. Not limited to this, performance may be different between the DACs 7 to 10 and the DAC 11. For example, the DAC 11 may be inferior in the DACs 7 to 10. A cheap device in which performance is inferior in the DACs 7 to 10 is used as the DAC 11 to reduce product unit price.

In the above mentioned first embodiment, in case that the DSD data is reproduced at the Zone2 output route, if the surround back digital audio signal is not input to the DAC 10, the microcomputer 2 connects the Zone2 reproduction device 6 with the DAC 10 by the switch 17 as illustrated in FIG. 2. Further, the microcomputer 2 connects the DAC 10 with the Zone2 analog output terminal 16 by the switch 18.

Herein, possibility that the surround back audio signal is always constant volume is low. For this reason, in case that the 7.1 channels digital audio signal is reproduced at the main output route, the Zone2 reproduction device 6 and the DAC 10 are connected by the switch 17, the DAC 10 and the Zone2 analog output terminal 16 are connected by the switch 18, and it is difficult for a user to sense interruption of sound of the surround back audio signal at the main output route.

Therefore, in case that the microcomputer 2 calculates average level of the surround back audio signal and the average level is less than given value, even if the 7.1 channels digital audio signal is reproduced at the main output route, the microcomputer 2 may connect the DSP 5 with the DAC 11 by the switch 17, connect the Zone2 reproduction device 6 and the DAC 10 by the switch 17, connect the DAC 11 with the surround back analog output terminal 15 by the switch 18, and connect the DAC 10 with the Zone2 analog output terminal 16. Namely, in case that the PCM data is reproduced at the main output route and the DSD data is reproduced at the Zone2 output route, the microcomputer 2 connects the DSP 5 with the DAC 11, connects the Zone2 reproduction device 6 with the DAC 10 by the switch 17, connects the DAC 11 with the surround back analog output terminal 15, and connects the DAC 10 and the Zone2 analog output terminal 16 by the switch 18.

In case like this, the DAC that D/A-converts the surround back audio signal is changed from the DAC 10 to the DAC 11. For this reason, the DSP 5 may correct difference in characteristics between the DAC 10 and the DAC 11. As correction, there is correction of group delay of a digital filter. The second embodiment is also the same.

In the above mentioned embodiment, the DSD data is illustrated as a first digital audio signal. The PCM data is illustrated as a second digital audio signal. Not limited to this, it is sufficient that the first digital audio signal and the second digital audio signal are different in data format. For example, the second digital audio signal may be data format in which data amount is larger than the first digital audio signal.

In the above mentioned embodiment, the main output route is 7.1 channels or 5.1 channels. The Zone2 output route is 2 channels. The number of channels is not limited to these.

In the above mentioned embodiment, the AV receiver is illustrated as an audio processing device. Not limited to this, it may be the other audio processing device.

The present invention can be suitably employed in the audio processing device that performs audio signal processing to the digital audio signal.

What is claimed is:

1. An audio processing device having a first output route and a second output route comprising:

a first reproduction device that is included in the first output route;

a second reproduction device that is included in the second output route;

a first D/A converter that D/A-converts a first digital audio signal and a second digital audio signal in which data format is different from the first digital audio signal;

a second D/A converter that D/A converts the second digital audio signal;

a first analog output terminal that is included in the first output route;

a second analog output terminal that is included in the second output route;

a first switch that connects the first reproduction device with the first D/A converter or the second D/A converter and connects the second reproduction device with the first D/A converter or the second D/A converter;

a second switch that connects the first D/A converter with the first analog output terminal or the second analog output terminal and connects the second D/A converter with the first analog output terminal or the second analog output terminal; and a controller that connects the second reproduction device with the first D/A converter by the first switch and connects the first D/A converter with the second analog output terminal by the second switch in case that the first digital audio signal is reproduced at the second output route.

2. The audio processing device according to claim 1, wherein the controller connects the second reproduction device with the first D/A converter by the first switch and connects the first D/A converter with the second analog output terminal by the second switch in case that the first digital audio signal is reproduced at the second output route if a digital audio signal is not input to the first D/A converter.

3. The audio processing device according to claim 1, wherein the controller connects the first reproduction device with the second D/A converter by the first switch, connects the second reproduction device with the first D/A converter by the first switch, connects the second D/A converter with the first analog output terminal by the second switch, and connects the first D/A converter with the second analog output terminal by the second switch in case that the second digital audio signal is reproduced at the first output route and the first digital audio signal is reproduced at the second output route.

4. An audio processing device having a first output route and a second output route comprising:

a first reproduction device that is included in the first output route;

a second reproduction device that is included in the second output route;

a first D/A converter that D/A-converts a digital audio signal;

a second D/A converter that D/A-converts the digital audio signal and in which performance is inferior in the first D/A converter;

a first analog output terminal that is included in the first output route;

a second analog output terminal that is included in the second output route;

a first switch that connects the first reproduction device with the first D/A converter or the second D/A converter and connects the second reproduction device with the first D/A converter or the second D/A converter;

a second switch that connects the first D/A converter with the first analog output terminal or the second analog output terminal and connects the second D/A converter with the first analog output terminal or the second analog output terminal; and a controller that connects the second reproduction device with the first D/A converter by the first switch and connects the first D/A converter with the second analog output terminal by the second switch in case that the digital audio signal is reproduced at the second output route.

5. The audio processing device according to claim 1, wherein the first output route reproduces a 7.1 channels digital audio signal, the second output route reproduces a 2 channels digital audio signal, the first D/A converter includes four D/A converters that respectively D/A-convert a 2 channels digital audio signal, the second D/A converter is a D/A converter that D/A-converts a 2 channels digital audio signal, the first switch connects a surround back port that outputs a surround back left digital audio signal and a surround back right digital audio signal of the first reproduction device with a surround back D/A converter for the surround back left digital audio signal and the surround back right digital audio signal of the first D/A converter or the second D/A converter and connects the second reproduction device with the surround back D/A converter or the second D/A converter, and the second switch connects the surround back D/A converter with a surround back analog output terminal for the surround back left analog audio signal and the surround back right audio signal of the first analog output terminal or the second analog output terminal and connects the second D/A converter with the surround back analog output terminal or the second analog output terminal.

6. The audio processing device according to claim 1, wherein the first output route reproduces a 5.1 channels digital audio signal, the second output route reproduces a 2 channels digital audio signal, the first D/A converter includes three D/A converters that respectively D/A-convert a 2 channels digital audio signal, the second D/A converter is a D/A converter that D/A-converts a 2 channels digital audio signal, the first switch connects a surround port that outputs a surround left digital audio signal and a surround right digital audio signal of the first reproduction device with a surround D/A converter for a surround left digital audio signal and a surround right digital audio signal among the first D/A converter or the second D/A converter and connects the second reproduction device with the surround D/A converter or the second D/A converter, and the second switch connects the surround D/A converter with a surround analog output terminal for the surround left analog audio signal and the surround right analog audio signal of the first analog output terminal or the second analog output terminal and connects the second D/A converter with the surround analog terminal or the second analog output terminal.

7. The audio processing device according to claim 1, wherein data amount of the first digital audio signal is larger than data amount of the second digital audio signal.

8. The audio processing device according to claim 1, wherein the first digital signal is DSD data, and the second digital audio signal is PCM data.

* * * * *